US007827811B2

(12) United States Patent
Ferragut, II et al.

(10) Patent No.: US 7,827,811 B2
(45) Date of Patent: Nov. 9, 2010

(54) REFRIGERATOR CONTROL INCLUDING A HIDDEN FEATURES MENU

(75) Inventors: Nelson J. Ferragut, II, Williamsburg, IA (US); Robert L. Wetekamp, Cedar Rapids, IA (US)

(73) Assignee: Maytag Corporation, Benton Harbor, MI (US)

( * ) Notice: Subject to any disclaimer, the term of this patent is extended or adjusted under 35 U.S.C. 154(b) by 1129 days.

(21) Appl. No.: 11/327,363

(22) Filed: Jan. 9, 2006

(65) Prior Publication Data

US 2007/0157637 A1 Jul. 12, 2007

(51) Int. Cl.
*F25B 49/00* (2006.01)
*F25D 11/02* (2006.01)

(52) U.S. Cl. ..... 62/126; 62/441

(58) Field of Classification Search ..... 62/126, 62/157, 441, 125, 127
See application file for complete search history.

(56) References Cited

U.S. PATENT DOCUMENTS 4,604,871 A 8/1986 Chiu et al.
4,851,662 A * 7/1989 Ott et al. ..... 250/214 AL
4,966,004 A 10/1990 Midlang et al.
5,451,930 A 9/1995 McDaniel
5,808,278 A 9/1998 Moon et al.
6,119,471 A * 9/2000 Tanaka et al. ..... 62/130
6,170,273 B1 1/2001 Bosi
6,216,956 B1 * 4/2001 Ehlers et al. ..... 236/47
6,397,606 B1 6/2002 Roh et al.
6,405,544 B2 6/2002 Hiraoka et al.
6,408,634 B1 6/2002 Choi
6,463,752 B2 * 10/2002 Mandel et al. ..... 62/382
6,483,695 B1 11/2002 Hartstein
6,497,113 B1 * 12/2002 Yamada et al. ..... 62/441
6,526,766 B1 3/2003 Hiraoka et al.
6,557,362 B1 5/2003 Wilson (Continued)

FOREIGN PATENT DOCUMENTS

JP 09264659 A * 10/1997

(Continued)

OTHER PUBLICATIONS

JP2001-349668A English Abstract Dec. 2001.*

(Continued)

*Primary Examiner*—Chen-Wen Jiang
(74) *Attorney, Agent, or Firm*—Kirk W. Goodwin; Diederiks & Whitelaw PLC

(57) ABSTRACT

A refrigerator includes a cabinet within which is defined a fresh food compartment and/or a freezer compartment. The refrigerator further includes a control panel or user interface that enables a consumer to input desired operating parameters. The interface is also provided with a plurality of temperature control elements and at least one auxiliary control element. The temperature control elements enable a consumer to set compartment temperatures in a first or basic mode. The auxiliary control element, in addition to serving a function in the basic mode, provides access to a hidden or advanced features menu. Once the hidden menu is accessed, the temperature control elements enable a consumer to select and adjust advanced operating parameters, such as enabling a Sabbath mode, setting a temperature display, altering an intensity of ambient light required to activate a dispenser light, activating an audible warm alarm and initiating a super cool feature.

18 Claims, 2 Drawing Sheets

U.S. PATENT DOCUMENTS

| | | | | |
|---|---|---|---|---|
| 6,564,561 | B2 * | 5/2003 | Daum et al. | 62/130 |
| 6,574,581 | B1 * | 6/2003 | Bohrer et al. | 702/130 |
| 6,644,046 | B2 | 11/2003 | Rho et al. | |
| 6,715,302 | B2 | 4/2004 | Ferragut, II | |
| 6,722,146 | B2 | 4/2004 | Roh et al. | |
| 6,795,871 | B2 | 9/2004 | Nolan et al. | |
| 6,802,186 | B2 * | 10/2004 | Holmes et al. | 62/187 |
| 6,804,974 | B1 * | 10/2004 | Voglewede et al. | 62/264 |
| 6,826,267 | B2 | 11/2004 | Daum et al. | |
| 6,842,721 | B2 | 1/2005 | Kim et al. | |
| 6,873,262 | B2 * | 3/2005 | Midlang | 340/585 |
| 6,882,280 | B2 | 4/2005 | Ferragut, II | |
| 6,974,925 | B2 | 12/2005 | Whitman | |
| 7,117,051 | B2 | 10/2006 | Landry et al. | |
| 7,201,005 | B2 * | 4/2007 | Voglewede et al. | 62/126 |
| 2002/0088238 | A1 * | 7/2002 | Holmes et al. | 62/155 |
| 2003/0139778 | A1 * | 7/2003 | Fischell et al. | 607/3 |
| 2003/0140639 | A1 * | 7/2003 | Gray et al. | 62/157 |
| 2004/0064699 | A1 * | 4/2004 | Hooker et al. | 713/170 |
| 2004/0154318 | A1 | 8/2004 | Roh et al. | |
| 2004/0211212 | A1 * | 10/2004 | Wood | 62/441 |
| 2004/0216472 | A1 | 11/2004 | Cho | |
| 2005/0103029 | A1 | 5/2005 | Kawahara et al. | |
| 2005/0132725 | A1 * | 6/2005 | Menten et al. | 62/126 |
| 2005/0133353 | A1 * | 6/2005 | Whitman | 200/333 |

FOREIGN PATENT DOCUMENTS

| | | | |
|---|---|---|---|
| JP | 2001349668 | A * | 12/2001 |

OTHER PUBLICATIONS

JP09-264-659 Machine translation Oct. 1997.*

* cited by examiner

REFRIGERATOR CONTROL INCLUDING A HIDDEN FEATURES MENU

BACKGROUND OF THE INVENTION

1. Field of the Invention

The present invention pertains to the art of refrigerators and, more particularly, to a control panel for a refrigerator having basic and hidden feature menus that are readily accessible by a consumer.

2. Discussion of the Prior Art

Controls for refrigerators are well known in the art. In general, refrigerators are capable of maintaining fresh food and freezer compartment temperatures within broad temperature ranges. In this manner, consumers can set a desired degree of cooling/freezing based upon personal preferences and/or local conditions. A typical temperature control requires a consumer to slide a lever or rotate a knob or dial to set desired temperatures for the fresh food and freezer compartments. However, while these controls remain on the market, a wide variety of more advanced controls have been developed over time.

While mechanical controls are simple to understand and operate, higher end refrigerators are typically provided with digital control interfaces. Most modern refrigerators are provided with a wide variety of features, such as climate controlled bins and special operating modes that require setting various parameters for the appliance. As such, the complexity of the control interfaces employed in the more modern refrigerators has increased. As a result, many consumers do not properly set compartment temperatures or take advantage of the many available features or options. Therefore, in order to simplify the interface, several manufacturers have embedded or hidden portions of the control functions. That is, certain information is available only after entering a specified code. While effective, this feature has been reserved for hiding service modes allowing access to error and diagnostic codes that are utilized only by service personnel.

Despite the controls present in the prior art, there still exists a need for an enhanced control interface for a refrigerator. More specifically, there is a need for a control interface that can appeal to consumers demanding simplified controls for setting basic functions, as well as those who desire the ability to exercise control over more advanced features.

SUMMARY OF THE INVENTION

The present invention is directed to a control panel or user interface for a refrigerator. In a manner known in the art, the refrigerator includes an outer shell or cabinet having arranged therein at least one liner which defines a fresh food compartment and a freezer compartment. The refrigerator further includes a door that is pivotally mounted relative to the cabinet shell which provides a consumer with access to items stored within, for example, the fresh food compartment.

In accordance with the invention, the user interface is provided with a plurality of control elements that enable a consumer to adjust various operating parameters of the refrigerator. More specifically, manipulation of the control elements allows a consumer to adjust fresh food compartment and/or freezer compartment temperatures. The temperatures are preferably indicated on a display which forms part of the user interface. In addition to temperature control elements, the user interface is provided with at least one auxiliary control element that enables control of various auxiliary parameters, such as a door alarm.

In accordance with the most preferred form of the invention, in addition to operating an auxiliary parameter, the auxiliary control element can be manipulated in such a way to access a hidden preferences menu. Preferably, by activating the auxiliary control element for a predetermined period of time, the hidden preferences menu becomes available. In further accordance with the most preferred form of the invention, the hidden preferences menu allows a consumer to adjust more advanced operating parameters of the refrigerator. For example, the hidden preferences menu preferably contains controls for enabling a Sabbath Mode, changing a temperature display between ° F. and ° C., adjusting an ambient light level at which a dispenser light activates, activating an audible high temperature alarm and/or establishing a Super Cool feature. With this arrangement, the user interface allows for basic adjustment of compartment temperatures while, at the same time, provides a consumer with an option of accessing more advanced operating parameters.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
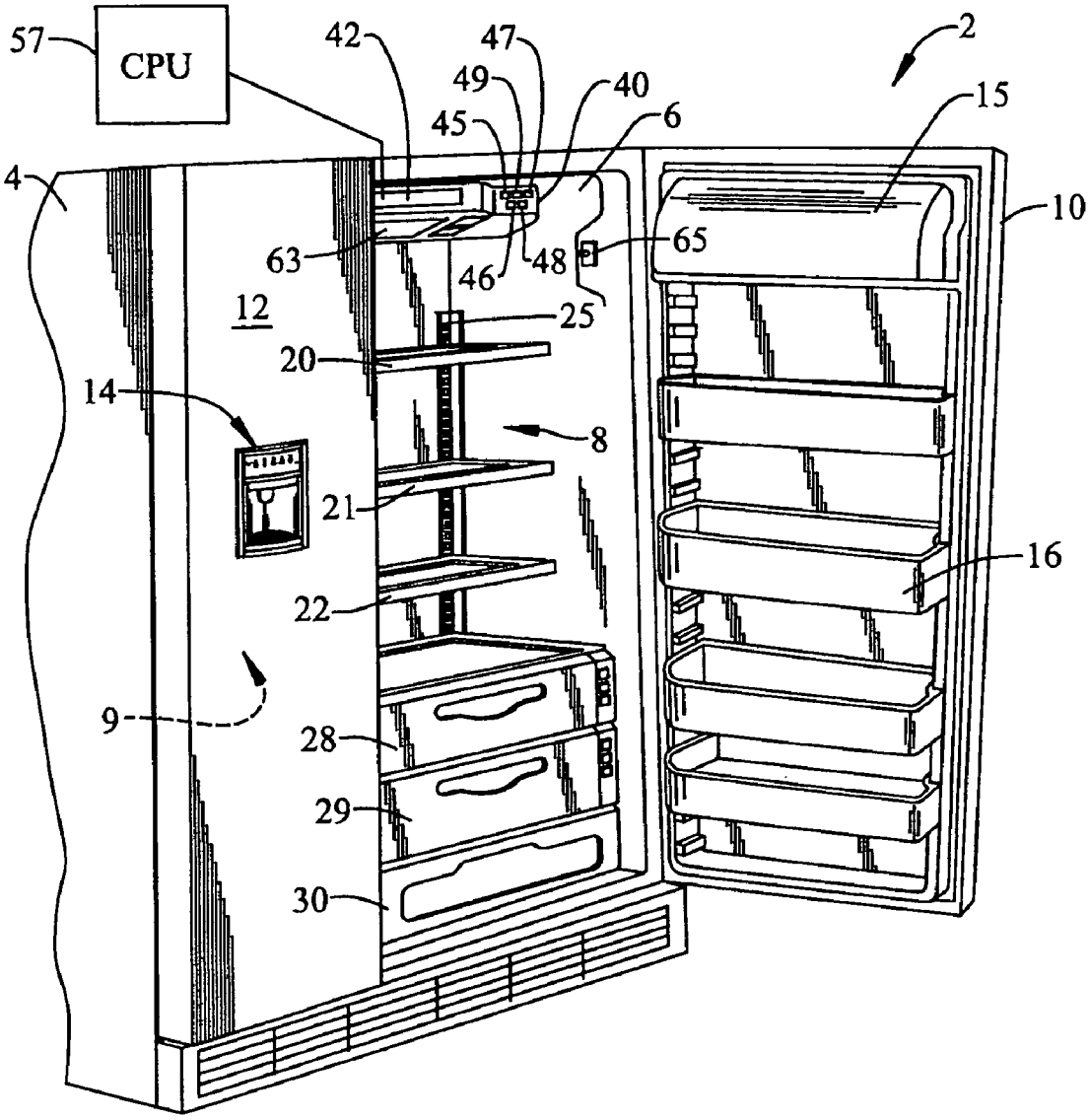
FIG. 1 is a partial perspective view of a refrigerator incorporating a control panel having a hidden features menu constructed in accordance with the present invention.

With initial reference to FIG. 1, a refrigerator 2 includes an outer shell or cabinet 4 within which is positioned a liner 6 that defines a fresh food compartment 8. Another liner (not shown) is also positioned in cabinet 4 to define a freezer compartment 9. In a manner known in the art, fresh food compartment 8 can be accessed by the selective opening of a fresh food door 10. In a similar manner, a freezer door 12 can be opened to access freezer compartment 9. In the embodiment shown, freezer door 12 includes a dispenser 14 that enables a consumer to retrieve ice and/or fresh water without accessing fresh food and freezer compartments 8 and 9. For the sake of completeness, door 10 of refrigerator 2 is shown to include a dairy compartment 15, as well as various vertically adjustable shelving units, one of which is indicated at 16. Also for the sake of completeness, fresh food compartment 8 is shown to include a plurality of vertically height adjustable shelves 20-22 supported by a pair of shelf support rails, one of which is indicated at 25. At a lowermost portion of fresh food compartment 8 is illustrated various temperature or climate controlled bins 28 and 29, as well as a more conventional storage compartment 30.

At an upper region of fresh food compartment 8 is a temperature control housing incorporating a user interface 40. In the embodiment shown, interface 40 includes a display zone 42 and a plurality of control elements 45-49. Control elements 45-48 are constituted by temperature control elements for adjusting a temperature of fresh food compartment 8 and freezer compartment 9, while control element 49 is constituted by an auxiliary control element for re-setting, for example, a door alarm. In addition, interface 40 is shown to include a controller or CPU 57 operatively coupled to refrigeration components (not shown), as well as a light 63 which, in a manner known in the art, is controlled by a switch 65 operated by the opening and closing of door 10.

In accordance with the invention, interface 40 is operable in a basic mode and in an advanced or hidden features mode. In the basic mode, interface 40 allows a consumer to adjust temperatures of fresh food compartment 8 and freezer compartment 9. That is, a consumer can simply manipulate control elements 45 and 46 to adjust a temperature of freezer compartment 9, manipulate control elements 47 and 48 to adjust a temperature of fresh food compartment 8 and/or manipulate control element 49 for re-setting a door alarm as indicated above.

Figure 2:
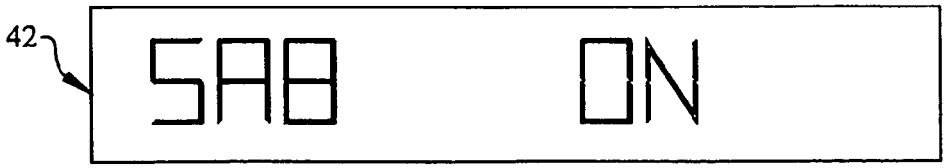
FIG. 2 is a plan view of a display zone of the control panel illustrating a first example of an advanced operating parameter available on the hidden features menu of the present invention.
Figure 3:
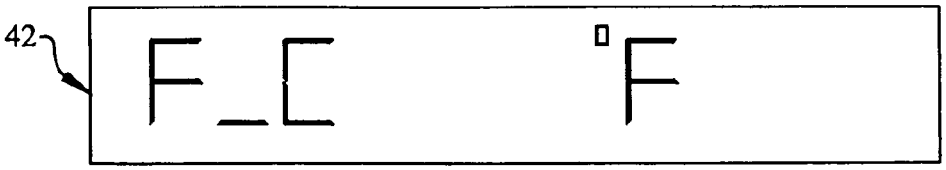
FIG. 3 is a plan view of a display zone of the control panel illustrating a second example of an advanced operating parameter available on the hidden features menu of the present invention.
Figure 4:
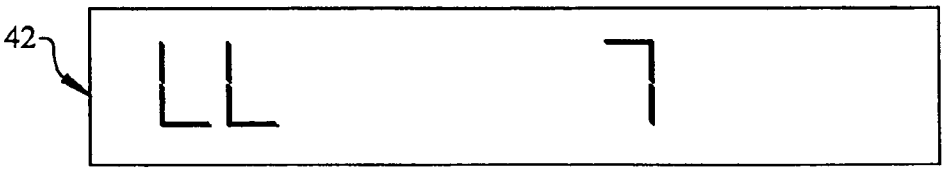
FIG. 4 is a plan view of a display zone of the control panel illustrating a third example of an advanced operating parameter available on the hidden features menu of the present invention.
Figure 5:
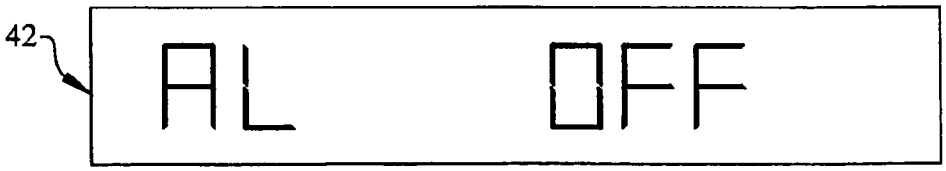
FIG. 5 is a plan view of a display zone of the control panel illustrating a fourth example of an advanced operating parameter available on the hidden features menu of the present invention.
Figure 6:
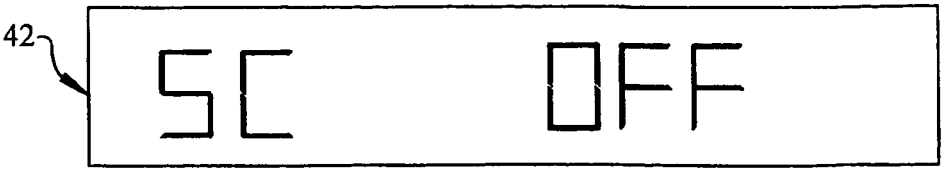
FIG. 6 is a plan view of a display zone of the control panel illustrating a fifth example of an advanced operating parameter available on the hidden features menu of the present invention.

However, in the event that a consumer desires to access more advanced features of refrigerator 2, auxiliary control element 49 is activated in a specific manner. That is, in accordance with a preferred form of the invention, control element 49 is activated for a predetermined period of time, for example, 3 seconds, in order to access the advanced or hidden features mode of interface 40. In the advanced or hidden features mode, a consumer can control advanced or special operating parameters of refrigerator 2. For example, operating parameters present within the advanced or hidden features mode can include toggling a Sabbath mode, as shown in FIG. 2, adjusting a temperature display to present temperatures in degrees Fahrenheit or in degrees Celsius as represented in FIG. 3, adjusting an ambient light level intensity at which a light (not separately labeled) in dispenser 14 will activate as represented in FIG. 4, enabling/disabling available audible alarms as represented in FIG. 5 (note visual alarms, e.g., flashing lights, may remain active), or activating a super cool feature as shown in FIG. 6.

In accordance with the most preferred form of the invention, once the advanced or hidden features mode of interface 40 is activated, manipulation of control elements 45 and 46 enables a consumer to scroll through the various features available in the advanced menu. Each feature and the status of the features are presented to the consumer on display zone 42. For example, in FIG. 2, control elements 45 and/or 46 have been manipulated to display the Sabbath mode which is shown to currently be in an "ON" state. Once the particular feature has been selected, altering or adjusting the state of that feature is carried out by manipulating control elements 47 and 48. Thus, for example, if a consumer desires to increase an ambient light level at which a light (not labeled) in dispenser 14 will be activated, control elements 45 and/or 46 are manipulated to bring the light level selection onto display zone 42 as evidenced in FIG. 4. At this point, the consumer need only manipulate control element 47 to incrementally increase the light level or, alternatively, control element 48 to incrementally decrease the light level.

Once all adjustments are complete, the advanced or hidden features mode should be deactivated. In accordance with one aspect of the invention, the hidden features mode is deactivated by again pressing or manipulating auxiliary control element 49 for a predetermined time, for example, 3 seconds. Alternatively, simply closing fresh food door 10 will deactivate the hidden features menu. Additionally, the hidden features menu is also deactivated upon passage of a predetermined time period. With this overall arrangement, it should be understood that user interface 40 constructed in accordance with the present invention allows simple adjustments of basic operating functions, such as temperature, without the need for a complicated interface or an in-depth knowledge of interface 40. More importantly, advanced features can be readily accessed if so desired. That is, by sequestering or hiding more advanced features, the user interface can remain simple while, at the same time, still enable a higher level of control of refrigerator 2.

Although described with reference to a preferred embodiment of the invention, it should be readily understood that various changes and/or modifications can be made to the invention without departing from the spirit thereof. For instance, while the interface is shown located in the fresh food compartment, other locations, such as on one of the doors of the refrigerator, would also be accessible. It should also be understood that the various operating parameters described are only several potentially available features. Therefore, other parameters could also be incorporated into the hidden features menu. In general, the invention is only intended to be limited by the scope of the following claims.

We claim:

1. A refrigerator comprising:

a cabinet within which is defined fresh food and freezer compartments;

a door pivotally mounted relative to the cabinet, said door selectively closing the fresh food compartment;

a display zone for selectively displaying operational parameters of the refrigerator; and a control panel for establishing operational parameters of the refrigerator, said control panel including:

means for setting a status of a basic operational parameter; and means for accessing a hidden features menu through the setting means, said hidden features menu enabling a consumer to set a status of at least one non-basic operational parameter of the refrigerator.

2. The refrigerator according to claim 1, wherein the setting means includes a plurality of control elements for establishing desired fresh food and freezer compartment temperatures.

3. The refrigerator according to claim 2, wherein the means for accessing the hidden features menu is constituted by activating one of the plurality of control elements for a predetermined period of time.

4. The refrigerator according to claim 3, wherein the means for accessing the hidden features menu constitutes activating one of the plurality of control elements for a few seconds.

5. The refrigerator according to claim 4, wherein the plurality of control elements includes a door alarm key, said one of the plurality of control elements constitutes the door alarm key.

6. The refrigerator according to claim 3, wherein the hidden features menu includes enabling a Sabbath mode, setting a temperature display, altering ambient light level intensity for activating a dispenser cavity light, activating a high temperature alarm and initiating a super cool feature.

7. The refrigerator according to claim 3, wherein at least one of the control elements is used to select a hidden feature to be displayed on the display zone and predetermined ones of the control elements are used to toggle a status of the select hidden feature.

8. The refrigerator according to claim 2, wherein the control panel is located within the cabinet.

9. A method of setting operational parameters of a refrigerator comprising:

accessing a basic features menu through selection of a predetermined one of a plurality of control elements;

selecting a basic feature from the basic features menu;

setting a status of the basic feature selected;

activating a hidden features menu through activation of at least one of the plurality of control elements, said at least one of the plurality of control elements also having a function other than accessing the hidden features menu;

selecting a hidden feature from the hidden features menu; and setting a status of the hidden feature selected.

10. The method according to claim 9, wherein setting the status of a basic feature includes selecting at least one of a fresh food compartment temperature and a freezer compartment temperature.

11. The method according to claim 10, wherein accessing the hidden features menu constitutes activating the predetermined one of the plurality of control elements for a predetermined period of time.

12. The method according to claim 9, further comprising: deactivating the hidden features menu through activation of the predetermined one of the plurality of control elements for a predetermined time period.

13. The method according to claim 12, further comprising: selecting a door alarm key as the predetermined one of the plurality of control elements.

14. The method according to claim 9, further comprising: deactivating the hidden features menu through shifting a door of the refrigerator from an open position to a closed position.

15. The method according to claim 9, further comprising: selecting the hidden feature from the group consisting of: a Sabbath mode, a temperature display, ambient light level intensity for activating a dispenser cavity light, a high temperature alarm and a super cool feature.

16. The method of claim 9, further comprising: deactivating the hidden features menu upon passage of a predetermined time period.

17. The, method according to claim 9, further comprising: toggling a status of the hidden feature selected through predetermined ones of the control elements.

18. The method of claim 9, further comprising: opening a door of the refrigerator to access the plurality of control elements.

* * * * *